United States Patent [19]

Wieneke

[11] Patent Number: 4,976,621

[45] Date of Patent: Dec. 11, 1990

[54] APPARATUS FOR STYLING HAIR REPLACEMENT

[75] Inventor: James E. Wieneke, Fairview Heights, Ill.

[73] Assignee: Apollo Hair Systems, Inc., Kansas City, Mo.

[21] Appl. No.: 290,758

[22] Filed: Dec. 27, 1988

[51] Int. Cl.[5] ..... G09B 9/00

[52] U.S. Cl. ..... 434/94; 446/100; 223/120

[58] Field of Search ..... 434/94, 100, 219, 270; 132/213, 53, 54, 56; 446/100, 391; 223/120, 66, 68; D20/32

[56] References Cited

U.S. PATENT DOCUMENTS

| | | | |
|---|---|---|---|
| D. 227,186 | 6/1973 | Dangeli | D20/32 |
| 1,942,370 | 3/1930 | Jacobson | 434/270 X |
| 2,307,523 | 3/1941 | Maisel | 446/391 |
| 3,310,267 | 8/1966 | Koehler | 223/66 X |
| 3,693,848 | 9/1972 | Breitbach | 223/66 |
| 3,709,407 | 1/1973 | Sanford | 223/66 |

FOREIGN PATENT DOCUMENTS

| | | | |
|---|---|---|---|
| 1120187 | 12/1961 | Fed. Rep. of Germany | 434/94 |
| 3713530 | 1/1988 | Fed. Rep. of Germany . | |
| 640682 | 9/1927 | France | 223/66 |

OTHER PUBLICATIONS

"*Apparel Forms Catalog*", LA Darling Co., 4/9/1965, p. 12.

*Primary Examiner*—Richard J. Apley
*Assistant Examiner*—Rachel M. Healey
*Attorney, Agent, or Firm*—Hovey, Williams, Timmons & Collins

[57] ABSTRACT

Apparatus for styling a hair replacement, the apparatus consisting of a headblock, in two forms, each form presenting an edge which simulates the front hairline of the ultimate user of the hair replacement whereby the edge may be utilized in styling the hair replacement when it is placed in overlying relationship to the headblock after manufacture and for styling. In one form, the edge is created by forming a flat face on the headblock and on the other form by defining a concavity in the face area of the headblock, the concavity having an upper wall which presents an edge for use in styling. The method of using the apparatus involves utilizing such a headblock by placing a hair replacement over the scalp area of the headblock with a portion of the hair replacement extending over the edge and then styling the hair replacement and leaving a portion of the hair replacement extending over the edge after styling so that when placed upon the head of the user the hair replacement will have a natural appearance.

9 Claims, 1 Drawing Sheet

APPARATUS FOR STYLING HAIR REPLACEMENT

BACKGROUND OF THE INVENTION

1. Field of the Invention

This invention relates to a headblock which is particularly intended for use by beauticians and hair stylists in the styling of a hair replacement after the hair replacement has been manufactured but before it is placed on the head of the user. The headblock is configured in such a manner as to provide an edge which corresponds to the front hairline of the ultimate user of the hair replacement, which edge is used in styling the hair replacement so that, once it is placed on the head of the user, there is a natural and desirable appearance to the hair replacement, particularly along the front hairline thereof.

2. Description of the Prior Art

Prior art headblocks for use in styling have been fabricated from a plastic, rubber or similar material and have a neck portion and a head portion, as does the headblock of this invention; however, the prior art headblocks, as shown in FIG. 6 of the drawing, have had the head portion thereof generally spherical in configuration whereby there is not presented any edge which simulates the front hairline of the ultimate user of the hair replacement and accordingly, it is difficult to style the hair replacement in such a manner that it looks natural once placed upon the head of the user.

SUMMARY OF THE INVENTION

Apparatus for use in styling a hair replacement which is in the form of a headblock having a neck portion and a head portion, the head portion being in two forms, both of which differ from the prior art spherical headblock.

Specifically, one form has a flattened face whereby an edge is presented, which edge may be utilized in styling the hair replacement since the hair may be brushed over the edge and then styled into a pompadour appearance at the front and, after styling, steamed in position so that once the hair replacement is on the head of the user, it presents a natural appearance, particularly along the front hairline.

Another form of the apparatus is in the nature of a headblock having a concavity therein between the scalp area and the forehead area, the concavity presenting an upper wall extending toward the scalp area and a lower wall extending toward the forehead area, the hair replacement being positionable in overlying relationship to the headblock whereby some of the hair is substantially within the concavity and may be styled by utilizing the aperture presented by the concavity.

In both forms, the edge is between what would be the scalp area and the forehead area of the ultimate user of the hair replacement and simulates the front hairline of such user, the edge being generally V-shaped in plan configuration and circumscribing that part of the headblock between the scalp area and the forehead area. The utilization of the unique headblock, by the method described herein, results in a hair replacement which is much more attractive and natural in its appearance once placed upon the head of the user.

DESCRIPTION OF PREFERRED EMBODIMENT

Figure 6:
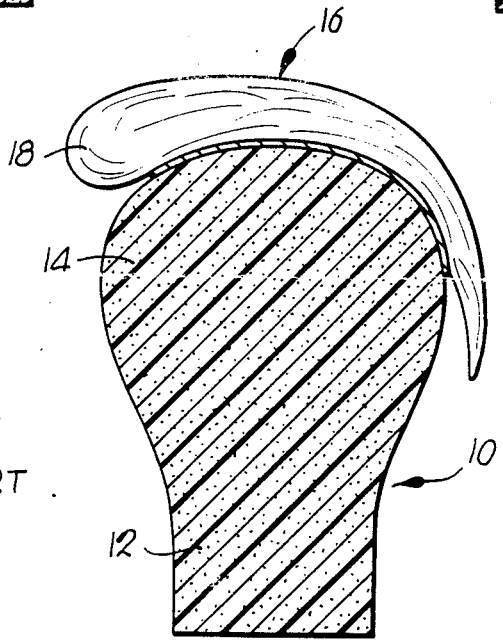
Fig.6. PRIOR ART
FIG. 6 is a central sectional view comparable to FIGS. 3 and 5 but showing the prior art headblock apparatus.

Headblocks such as heretofore known, as illustrated at 10 in FIG. 6 of the drawing, have included a neck portion 12 and a head portion 14. However, the head portion 14 was essentially entirely spherical in its configuration whereby when a hairpiece such as 16 was placed upon the prior art headblock 10 for styling, there was no way in which the front edge or front hairline of the hair replacement could be styled in a way to simulate the natural and attractive front hairline desired when the hair replacement 16 was ultimately placed on the head of a user.

As is evident from FIG. 6, the styling of the hairpiece in a pompadour style left the pompadour 18 of the hairpiece 16 positioned in such a way that it would be spaced upwardly and backwardly from the forehead of the ultimate user which is not the natural appearance.

Rather, it is desired to have the pompadour or front hairline portion of the hair replacement cover a portion of the forehead of the ultimate user and, in order to accomplish this end result, it is necessary that the headblock utilized in styling the hair replacement after it has been manufactured, more closely simulate the configuration of the head of the ultimate user.

Figure 1:
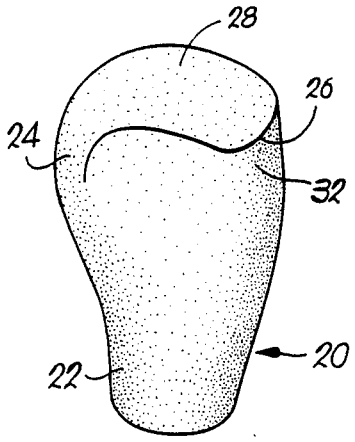
FIG. 1 is a front perspective view showing one form of the headblock apparatus.
Figure 2:
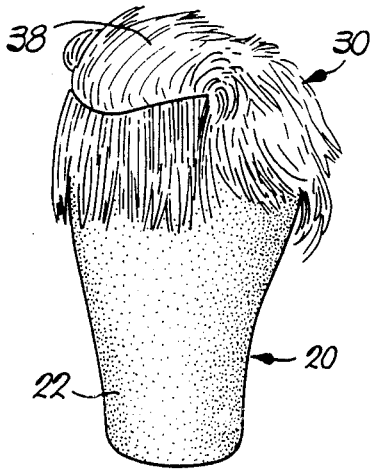
FIG. 2 is another perspective view of the one form of the headblock apparatus showing a hair replacement piece thereon prior to styling.
Figure 3:
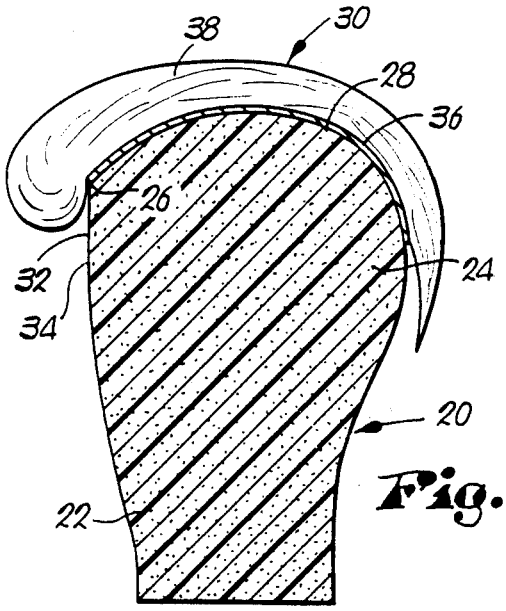
FIG. 3 is a central sectional view of the one form of headblock showing the hair replacement thereon after styling.

Accordingly, and to achieve this desired result, a first form of headblock is disclosed herein, this being shown in FIGS. 1, 2 and 3. This headblock is identified by numeral 20 and includes a neck portion 22 and a head portion 24.

However, rather than being completely spherical in configuration, as in the prior headblock 10, the headblock 20 is configured in such a manner as to present an edge 26, which edge is presented at what would be the front hairline of the ultimate user of the hair replacement.

Thus, the headblock 20 and particularly the head portion 24 thereof, presents a surface 28 which would normally be the surface receiving the hairpiece such as 30 illustrated in FIG. 2, in overlying relationship thereto during styling.

The surface 28 is what might be described as the scalp area of the headblock and is separated from what may be described as the forehead area 32 by the line or edge 26.

In the form disclosed in FIGS. 1, 2 and 3, the edge 26 is created by configuring the headblock 20 in such a manner that the front of the head portion 24 thereof is flat as at 34, illustrated in FIG. 3, whereby the edge 26 is presented at what would be the juncture between the forehead area 32 and the scalp area 28 of the headblock. The scalp area 28 retains its generally spherical configuration since this is the normal configuration of the scalp area of a user of a hair replacement.

As best shown in FIG. 3, and for purposes of styling, the hair replacement 30 is positioned in overlying relationship to the scalp surface area 28, the base of netting or the like 36 being in direct contact with the area 28 and the artificial or natural fibers which constitute the hair replacement being above the base 36 as at 38.

When the hair replacement 30 is initially placed atop the headblock 20 and more particularly in overlying relationship to the scalp surface area 28, the hairs 38 would be brushed out, as illustrated in FIG. 2, and the hair replacement then styled.

It will be appreciated that, by having the edge 26 presented by the headblock 20, which edge 26 simulates the front hairline of the ultimate user of the hair replacement, the hair replacement 30 may be more naturally styled since the hair can be brought down below the edge 26 and styled for instance into a front pompadour style as shown in FIG. 3 of the drawing.

After such styling has been accomplished, the hair replacement 30 may then be removed from the headblock and positioned on the head of the user and the hair replacement 30 will assume a natural appearance due to the fact that the hair at the front portion thereof has been styled through utilization of the edge 26 which simulates the natural configuration of the head of a user.

It should be noted that, as best shown in FIG. 1 for instance, the edge 26, in defining the front hairline with respect to the hair replacement, is generally V-shaped in plan configuration and circumscribes that part of the headblock between the forehead area 32 and the scalp area 28. Thus, the headblock 20 has a configuration essentially simulating the configuration of the head of the ultimate user, thereby permitting styling of the hair replacement 30 in a realistic fashion.

Figure 4:
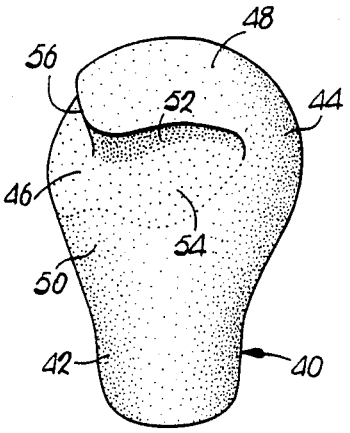
FIG. 4 is a front perspective view of the second form of headblock.
Figure 5:
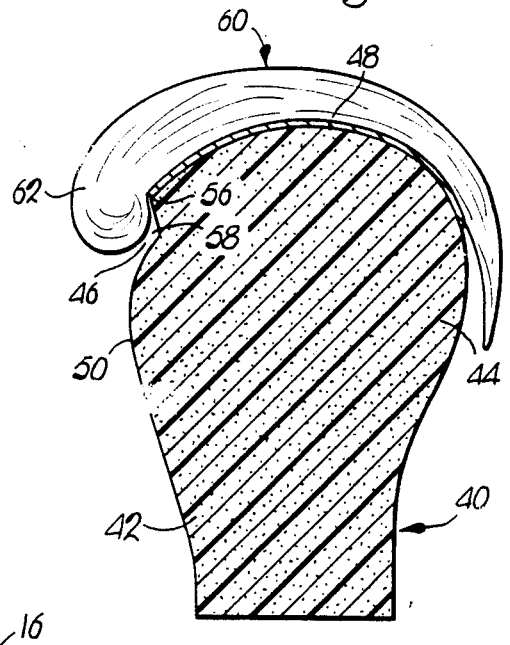
FIG. 5 is a central sectional view of the second form of headblock showing the hair replacement thereon after styling.

Another apparatus for accomplishing the same result is illustrated in FIGS. 4 and 5 of the drawing and wherein there is a headblock 40 having a neck portion 42 and a head portion 44. In this form, the head portion 44 is provided with a concavity 46, which is in the headblock between the scalp area 48 and the face area 50 of the headblock, the concavity essentially being in place of what would be the forehead of the headblock.

The concavity presents an upper wall 52 and a lower wall 54. The upper wall 52 extends toward the scalp area and defines an edge 56 which is generally comparable to edge 26 and which is proximal to the scalp area 48.

The concavity 46 is of sufficient depth that an aperture 58 is presented in the normally front face of the headblock 40 whereby the hair replacement 60 which is placed in overlying relationship to the scalp area 48, may have the front hairs 62 thereof combed forwardly beyond the edge 56 and into the aperture 58 for purposes of styling, all as is readily apparent from FIG. 5 of the drawing. This particular configuration as illustrated in FIGS. 4 and 5 permits even greater flexibility in the styling of the hair replacement 60 since there is yet further additional area within which the hair may be worked; that is, aperture 58.

As in the preceding form, the edge 56 of headblock 40 circumscribes that part of the headblock between the scalp area and the forehead area and defines, in simulation, the front hairline of the prospective user of the hair replacement. The edge 56 is generally V-shaped in configuration and has a configuration corresponding to that of the head between the scalp area 48 and what would be the forehead area which is, in this form, replaced by concavity 46.

It will be appreciated that in utilizing the two forms of headblock 20 and 40 hereinabove disclosed and described, a hair replacement may be positioned in overlying relationship to the scalp area of the headblock whereby the hair replacement is adjacent the edges defined as at 26 and 56, which edges simulate the front hairline of the prospective user of the hair replacement.

Once the hair replacement has been positioned over the scalp area, the hair may be styled by utilizing the front edges 26 or 56 as a guideline so that the hair may be positioned desirably with respect to the forehead of the user. Normally, after the hair has been styled, a portion thereof will remain in a position extending over front edges such as 26 or 56 so that after the hair replacement is removed from the styling block, it may be positioned on the head of the user and the hair of the replacement retain its same configuration and appearance which is a natural look which is highly desirable, particularly in the use of a hair replacement.

What is claimed is:

1. Apparatus for use in styling a hair replacement comprising:

a headblock having a neck portion and a head portion, the head portion presenting a surface for receiving the hair replacement in overlying relationship thereto for styling, an edge presented by said surface, said edge defining between a scalp area and a forehead area of the head portion of the headblock, there being a concavity extending over a significant portion of the forehead area in the headblock between the scalp area and the forehead area, said concavity presenting an upper wall extending toward the scalp area and a and a gradually sloped lower wall extending toward the forehead area, the slope of said upper wall proximal to the scalp area being more drastic than said gradual slope of said lower wall.

2. Apparatus as set forth in claim 1, said upper wall defining said edge, said edge being proximal to the scalp area.

3. Apparatus as set forth in claim 1, said edge defining a front hair line with respect to the hair replacement.

4. Apparatus as set forth in claim 3, said hair replacement extending over the edge during and after styling.

5. Apparatus as set forth in claim 4, said edge being generally V-shaped in plan configuration.

6. Apparatus as set forth in claim 5, said edge having a configuration corresponding to that of the head between the scalp area and the forehead area.

7. Apparatus for use in styling a hair replacement of the type presenting a section extending below the normal upper hairline and lying adjacent the forehead, said apparatus comprising:

a headblock including a neck portion and a head portion having a front area and a rear area, the head portion presenting a first, arcuate in cross section, scalp-simulating surface extending from the front to the back areas of the headblock for receiving said hair replacement for styling thereof, a second, upper, forehead-simulating surface below said scalp-simulating surface, and a sharp edge cooperatively defined by said first and second surface at the joinder thereof, said sharp edge being generally V-shaped in plan configuration and circumscribing only that part of the headblock between the scalp-simulating surface and the forehead-simulating surface, said hair replacement positioned on said sharp edge thus presenting a natural appearance along the normal upper hairline, said second surface being generally rectilinear in cross section and depending directly from said sharp edge, with the second surface extending frontally no further than said sharp edge, for defining with the sharp edge thereabove, a region for receiving said hair replacement section and permitting natural styling thereof.

8. Apparatus as set forth in claim 7, said second surface extending rearwardly from said sharp edge, there being a third surface extending forwardly from the lower end of said second surface, said second and third surfaces cooperatively presenting a concavity beneath said sharp edge.

9. Apparatus as set forth in claim 7, said second surface extending generally vertically from said sharp edge and being substantially smooth and uninterrupted.

* * * * *